US008052272B2

(12) United States Patent
Smith et al.

(10) Patent No.: US 8,052,272 B2
(45) Date of Patent: Nov. 8, 2011

(54) FLUID-EJECTION DEVICE HAVING ROLLERS

(75) Inventors: David L. Smith, Corvallis, OR (US); Timothy Jay Bouma, Corvallis, OR (US); Thomas M. Twigg, Corvallis, OR (US); George C. Ross, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 427 days.

(21) Appl. No.: 12/390,479

(22) Filed: Feb. 22, 2009

(65) Prior Publication Data

US 2010/0214360 A1 Aug. 26, 2010

(51) Int. Cl.
*B41J 2/01* (2006.01)
*B41J 29/38* (2006.01)

(52) U.S. Cl. ..... 347/101; 347/16

(58) Field of Classification Search ..... 347/101, 347/104, 16

See application file for complete search history.

(56) References Cited

U.S. PATENT DOCUMENTS 6,161,973 A * 12/2000 Kawamura et al. ..... 400/582
6,309,046 B1 10/2001 Izawa et al.
7,108,351 B2 9/2006 Izawa et al.
2001/0040615 A1* 11/2001 Beauchamp et al. ..... 347/103
2002/0057321 A1* 5/2002 Rasmussen et al. ..... 347/101
2005/0012774 A1 1/2005 Izawa et al.
2005/0200678 A1* 9/2005 Gao et al. ..... 347/104
2008/0074447 A1* 3/2008 Kondo ..... 346/138
2009/0122126 A1* 5/2009 Ray et al. ..... 347/102

FOREIGN PATENT DOCUMENTS

JP 2005297315 A * 10/2005

* cited by examiner

*Primary Examiner* — Stephen Meier
*Assistant Examiner* — Leonard S Liang

(57) ABSTRACT

A first roller has a first roller center line; a second roller has a second roller center line. Fluid-ejection mechanisms eject fluid onto the media as the media is rolled past the rollers, and include first mechanisms and second mechanisms. The first mechanisms include first and second printheads, at least substantially equally between which a first positioning line is defined. The second mechanisms include third and fourth printheads, at least substantially equally between which a second positioning line is defined. The fluid-ejection mechanisms are disposed opposite to the roller and are positioned such that the first and second positioning lines are located between the first and second roller center lines, the first and the third printheads are not completely located between the first and the second roller center lines, and the second and the fourth printheads are completely located between the first and the second roller center lines.

15 Claims, 8 Drawing Sheets

FLUID-EJECTION DEVICE HAVING ROLLERS

BACKGROUND

A fluid-ejection device is a type of device that ejects fluid in a controlled manner. For example, one type of fluid-ejection device is an inkjet-printing device, in which ink is ejected onto media to form an image on the media. Furthermore, a roller-based fluid-ejection device includes printheads that eject fluid onto media as the media moves past a series of rollers.

DETAILED DESCRIPTION

Description of Problem

To optimize printing quality within a roller-based fluid-ejection device, the spacing between the printheads of the device and the media while fluid ejection onto the media occurs is desirably substantially the same for all the printheads, and the media desirably remains stable while such fluid ejection occurs. In this section of the detailed description, these problems are described in more detail in relation to a representative roller-based fluid-ejection device. In the following section of the detailed description, an inventive and novel solution to these problems is then described.

Figure 1:
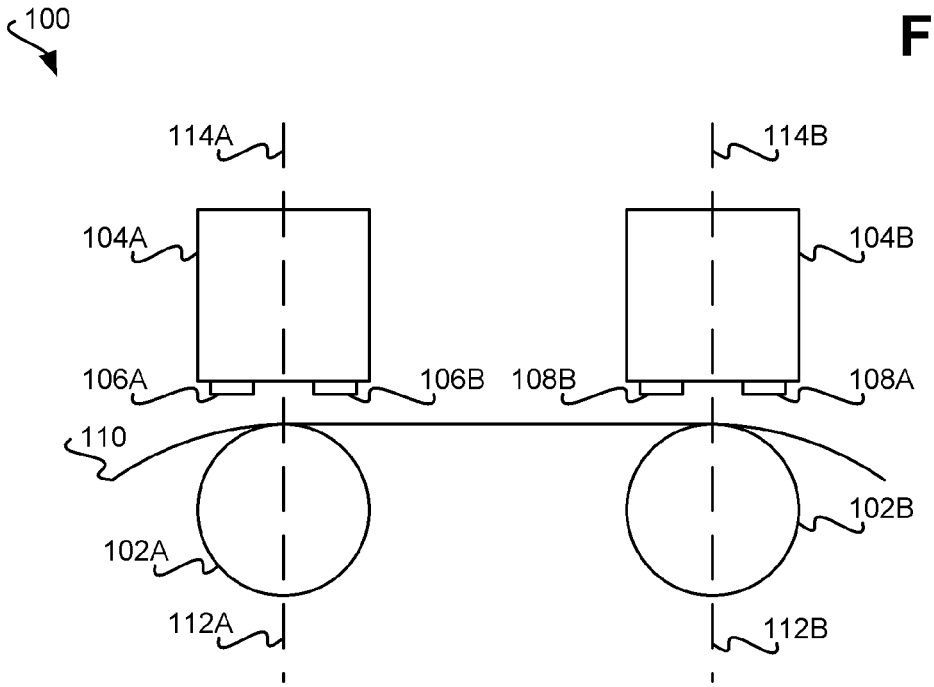
FIG. 1 is a diagram of a representative roller-based fluid-ejection device, according to an embodiment of the present disclosure.

FIG. 1 shows a representative roller-based fluid-ejection device 100, according to an embodiment of the present disclosure. The fluid-ejection device 100 includes a pair of rollers 102A and 102B, collectively referred to as the rollers 102, as well as a pair of fluid-ejection mechanisms 104A and 104B, collectively referred to as the fluid-ejection mechanisms 104. The fluid-ejection mechanisms 104 may also be referred to as pens, in the parlance of those of ordinary skill within the art.

The fluid-ejection mechanism 104A includes printheads 106A and 106B, collectively referred to as the printheads 106, and the fluid-ejection mechanism 104B includes printheads 108A and 108B, collectively referred to as the printheads 108. The printheads 106 and 108 includes series of nozzles (not shown in FIG. 1) through which fluid ejection occurs. Thus, insofar as the fluid-ejection mechanisms 104 eject fluid, it is the printheads 106 and 108 of the fluid-ejection mechanisms 104 that actually eject fluid, and more specifically the fluid is ejected through the nozzles of the printheads 106 and 108. The fluid-ejection mechanisms 104 eject fluid onto media 110 as the media 110 moves past the rollers 102, such as from left to right or from right to left in FIG. 1.

The fluid-ejection mechanisms 104 are positioned relative to the rollers 102 in FIG. 1 as follows. A first roller center line 112A is defined in relation to the roller 102A, and a second roller center line 112B is defined in relation to the roller 102B, where the roller center lines 112A and 112B are collectively referred to as the roller center lines 112. As its name suggests, a roller center line defines the center line of a roller, such that at least substantially half of the roller in question is to one side of the center line and at least substantially half of this roller is to the other side of the center line.

Furthermore, the fluid-ejection mechanism 104A includes a positioning line 114A and the fluid-ejection mechanism 104B includes a positioning line 114B, where the positioning lines 114A and 114B are collectively referred to as the positioning lines 114. A positioning line is defined as the line through the fluid-ejection mechanism in question such that the printheads of the fluid-ejection mechanism are at least substantially equally positioned to either side of the positioning line. For example, the positioning line 114A is defined at least substantially equally between the printheads 106, and the positioning line 114B is defined at least substantially equally between the printheads 108.

In FIG. 1, the fluid-ejection mechanisms 104 are positioned relative to the rollers 102 such that the positioning lines 114 are collinear with the roller center lines 112. That is, the positioning line 114A is collinear with the roller center line 112A, and the positioning line 114B is collinear with the roller center line 112B. However, such positioning of the fluid-ejection mechanisms 104 can be problematic to optimizing print quality, as is now described in more detail.

In particular, the spacing between the printheads 106 and 108 and the media 110 is not at least substantially equal for all the printheads 106 and 108. Between the roller center lines 112 of the rollers 102, the media 110 is substantially flat and is substantially parallel to the fluid-ejection mechanisms 104. However, to the left of the roller center line 112A of the roller 102A and to the right of the roller center line 112B of the roller 102B, the media 110 is not necessarily substantially flat, and is not substantially parallel to the fluid-ejection mechanisms 104. Rather, to the left of the roller center line 112A and to the right of the roller center line 112B, the media 110 falls away from the fluid-ejection mechanisms 104, in often an imprecise manner.

While the spacing between the printhead 106B and the media 110 is at least substantially equal to the spacing between the printhead 108B and the media 110A, the spacing between the printhead 106A and the media 110 and the spacing between the printhead 108A and the media 110 are not at least substantially equal to the spacings between the printheads 106B and 108B and the media 110. Indeed, the spacing between the printhead 106A and the media 110 may not even be equal to the spacing between the printhead 108A and the media 110. This means that ejection of the fluid onto the media 110 by the printheads 106A and 108A is not able to be as precisely controlled as the ejection of the fluid onto the media 110 by the printheads 106B and 108B is. As such, printing quality can suffer. It is noted that the media 110 is in contact with the rollers 102 at the roller center lines 112, but between the roller center lines 112 the media 110 is not in contact with the rollers 102.

One approach that the inventors tried in order to overcome the unequal printhead-media spacing problem that affects printing quality was to move both of the fluid-ejection mechanisms 104 inwards relative to the rollers 102, so that the positioning lines 114 are located between the roller center lines 112, and so that all the printheads 106 and 108 are completely located between the roller center lines 112. That is, the fluid-ejection mechanism 104A is moved well to the right of the roller 102A, and the fluid-ejection mechanism 104B is moved well to the left of the roller 102B. This approach ensures that all the fluid-ejection nozzles of all the printheads 106 and 108 of both the fluid-ejection mechanisms 104 are completely located between the roller center lines 112. As such, the spacing between the printhead 106A and the media 110, the spacing between the printhead 106B and the media 110, the spacing between the printhead 108A and the media 110, and the spacing between the printhead 108B and the media 110 are all at least substantially equal.

However, the inventors determined that this approach is less than ideal. While the approach maintains substantially equal printhead-media spacing, it undesirably results in the media 110 being unsupported at the locations where the printheads 106 and 108 eject fluid on the media 110. It is said that the media 110 is fully supported during fluid ejection by a given printhead where the portion of the media 110 on which the given printhead ejects fluids is in contact with a roller. Thus, where the fluid-ejection mechanisms 104 are located inwards relative to the rollers 102 such that all the printheads 106 and 108 and all the fluid-ejection nozzles of these printheads 106 and 108 are located between the roller center lines 112, the media 110 is completely unsupported at the locations where the printheads 106 and 108 eject fluid.

This situation is problematic, because it renders the media 110 susceptible to the effects of the media fluttering at the locations on which the printheads 106 and 108 eject fluid. During operation of the fluid-ejection device 100, vibrations within the device 100 (including the media transport system within the device 100, which is not shown in FIG. 1, to move the media within the device 100) can cause the media 110 to quickly move up and down, or flutter, where the media 110 is unsupported, which can affect print quality. Thus, moving the fluid-ejection mechanisms 104 inwards of the rollers 102 so that the printheads 106 and 108 and their fluid-ejection nozzles are completely between the roller center lines 112 may be a solution to the unequal printhead-media spacing problem. However, the inventors have determined that the solution is itself problematic, because it causes a different problem—media instability.

The inventors have also determined that media instability results from the positioning of the fluid-ejection mechanisms 104 in relation to the rollers 100 as depicted in FIG. 1, even without moving the mechanisms 104 inwards relative to the rollers 100 as has been described. That is, even when the positioning lines 114 of the fluid-ejection mechanisms 104 are collinear with the roller center lines 112 of the rollers 102, media instability can result. In particular, where the rollers 102 have relatively small diameters, the media 110 is not well supported during fluid ejection by specifically the printheads 106B and 108B.

In this respect, it is noted that the greater the distance between the roller and the portion of the media 110 on which the given printhead ejects fluid, the more unsupported the media 110 is during such fluid ejection. In FIG. 1, the media 110 is unsupported between the roller center lines 112 of the rollers 102, because the media 110 does not make contact with the rollers 102 in these locations. Therefore, the smaller the diameters that the rollers 102 have, the more unsupported the media 110 is during fluid ejection by the printheads 106B and 108B, because the distance between the rollers 102 and the portions of the media 110 on which fluid is ejected by the printheads 106B and 108A is greater.

Figure 2:
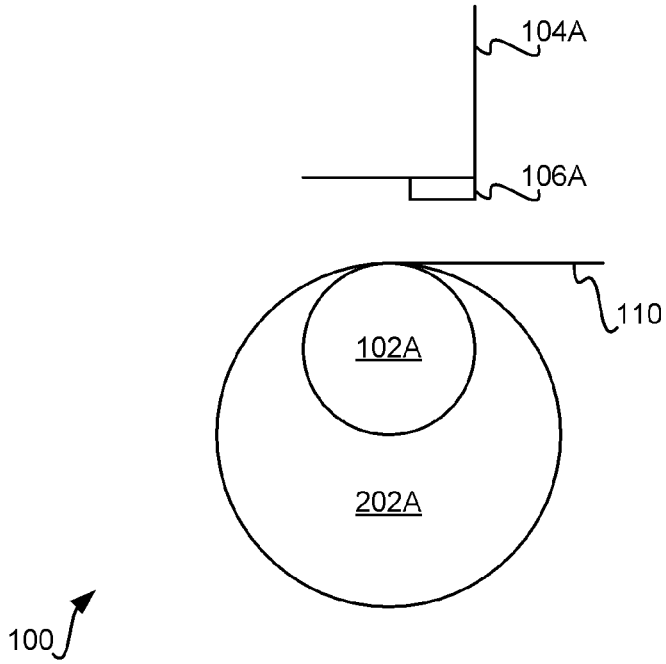
FIG. 2 is a diagram depicting how increasing roller diameter decreases media instability, according to an embodiment of the present disclosure.

FIG. 2 illustratively depicts this relationship in relation to a portion of the fluid-ejection device 100 of FIG. 1, according to an embodiment of the disclosure. In FIG. 2, the roller 102A is depicted, as is another roller 202A. Due to the greater diameter of the roller 202A, the distance between the portion of the media 110 on which the printhead 106B of the fluid-ejection mechanism 104A ejects fluid and the roller 202A is less than the distance between this portion of the media 110 and the roller 102A. As such, this portion of the media 110 is less supported by the roller 102A than it is if the roller 202A were instead used. It is noted that the more supported a portion of media is during fluid ejection on the media, the more stable the portion is during fluid ejection. Furthermore, the more unstable the portion of media is, the more susceptible the portion of media is to the effects of the media fluttering (i.e., moving up and down quickly as a result of vibrations within the fluid-ejection device).

Therefore, one approach that the inventors tried in order to overcome the media instability problem associated with the fluid-ejection device 100 of FIG. 1 that affects printing quality was to increase the diameters of the rollers 102. However, the inventors determined that this approach is less than ideal. First, it renders the resulting fluid-ejection device 100 much more complex. Ideally, the rollers 102 are not powered; that is, the rollers 102 rotate due to the frictional force of the media 110 moving past the rollers being greater than the inertial force of the rollers 102 that resist their rotation. However, increasing the diameters of the rollers 102 increases this inertial force that resists the rotation of the rollers 102. As such, one or both of the rollers have to become powered, where motors rotate the rollers.

Second, the larger the diameters of the rollers 102, the more constrained the configuration of the resulting fluid-ejection device 100 is. Where the fluid-ejection device 100 has a predetermined size, for instance, increasing the diameters of the rollers 102 decreases the amount of space available to place other components of the device 100. In particular, where there are a number of such pairs of rollers 102 within the fluid-ejection device 100, increasing the diameters of these rollers 102 limits the number of locations in which the rollers 102 can be placed within the device 100, and can even limit the number of the rollers 102 within the device 100. Therefore, while increasing the diameter of the rollers 102 may be a solution to the media instability problem that affects print quality within the fluid-ejection device 100, the inventors have determined that the solution is problematic.

To summarize, therefore, the fluid-ejection device 100 suffers from both unequal printhead-media spacing and media instability problems. The inventors initially attempted two solutions to overcome these problems. First, the inventors tried to position the fluid-ejection mechanisms 104 inwards of the rollers 102 so that the printheads 106 and their fluid-ejection nozzles were completely between the roller center lines 112. However, while this solution solved the unequal printhead-media spacing problem, it exacerbated the media instability problem. Second, the inventors tried to increase the diameters of the rollers 102. However, while this solution mitigated the media instability problem, it was unwieldy and impractical.

Description of Solution

In this section of the detailed description, a solution to the unequal printhead-media spacing problem and the media instability problems described in the previous section of the detailed description that avoids the pitfalls of the previously described solutions is presented. The inventors arrived at this novel and inventive solution after having tried the other approaches described in the previous section of the detailed description. In general terms, the solution invented by the inventors locates the positioning lines of the fluid-ejection mechanisms inwards of and between the roller center lines of the rollers. However, at least one printhead of each fluid-ejection mechanism is not completely located between the roller center lines, whereas at least one other printhead of each fluid-ejection mechanism is completely located between the roller center lines. This novel approach substantially solves the problems noted above, while avoiding the pitfalls of the previously described solutions. The approach is now described in detail.

Figure 3:
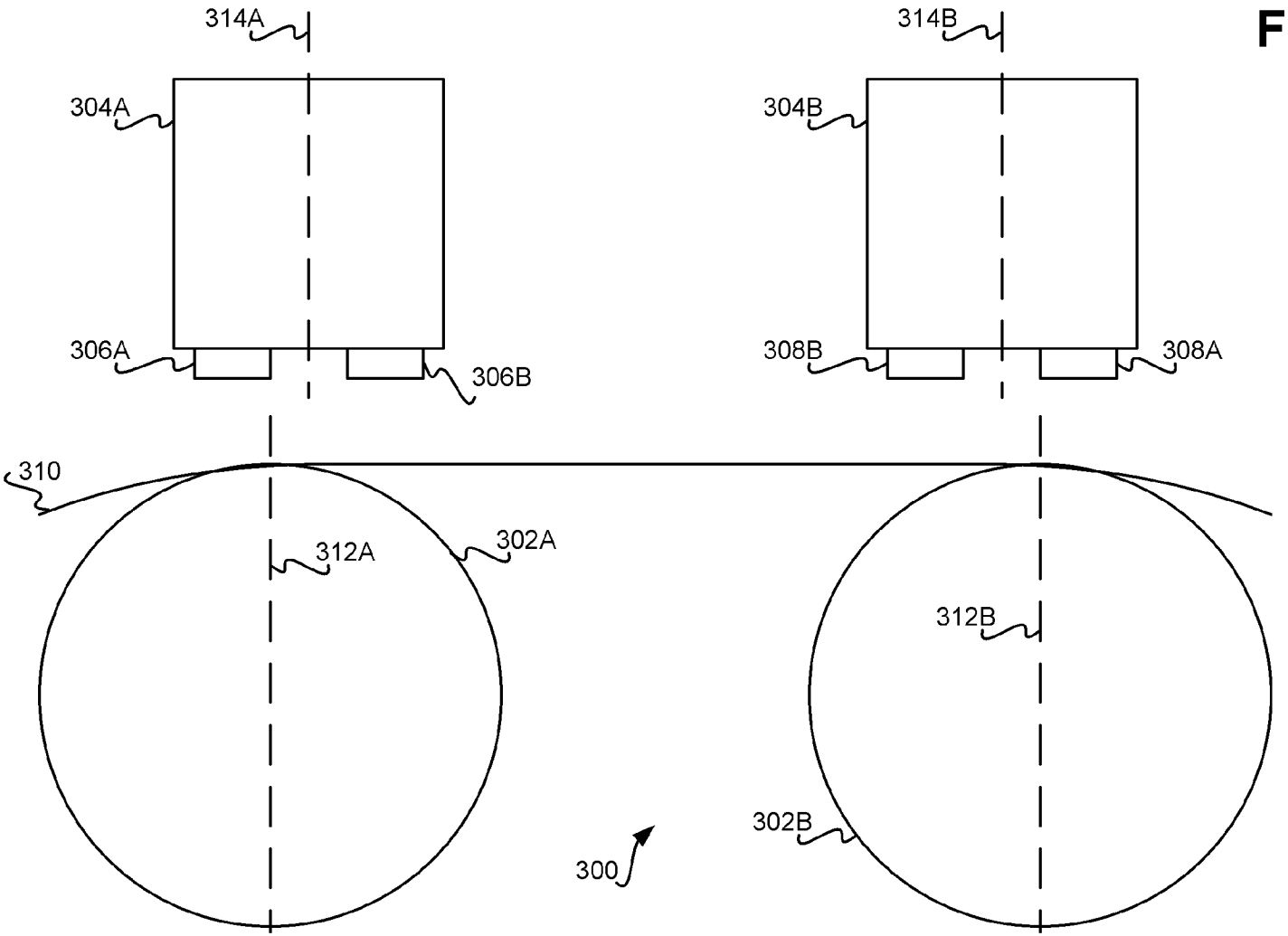
FIG. 3 is a diagram of a roller-based fluid-ejection device, according to an embodiment of the present disclosure.

FIG. 3 shows a roller-based fluid-ejection device 300, according to an embodiment of the present disclosure. It is noted that FIG. 3 is not necessarily drawn to scale, for illustrative clarity and convenience. The fluid-ejection device 300 may be an inkjet-printing device, which is a device, such as a printer, that ejects ink onto media, such as paper, to form images, which can include text, on the media. The fluid-ejection device 100 is more generally a fluid-ejection precision-dispensing device that precisely dispenses fluid, such as ink. The fluid-ejection device 100 may eject pigment-based ink, dye-based ink, another type of ink, or another type of fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. As such, a fluid-ejection precision-dispensing device is in comparison to a continuous precision-dispensing device, in which a substantially liquid fluid is continuously dispensed therefrom. An example of a continuous precision-dispensing device is a continuous inkjet-printing device.

The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

The fluid-ejection device 300 includes a pair of rollers 302A and 302B, collectively referred to as the rollers 302, as well as a pair of fluid-ejection mechanisms 304A and 304B, collectively referred to as the fluid-ejection mechanisms 304. The fluid-ejection mechanisms 304 may also be referred to as pens, in the parlance of those of ordinary skill within the art. Furthermore, the fluid-ejection device 300 can and typically does include other components, in addition to and/or in lieu of those depicted in FIG. 3.

The fluid-ejection mechanism 304A includes printheads 306A and 306B, collectively referred to as the printheads 306, and the fluid-ejection mechanism 304B includes printheads 308A and 308B, collectively referred to as the printheads 308. The printheads 306 and 308 include series of nozzles (not shown in FIG. 3) through which fluid ejection occurs. Thus, insofar as the fluid-ejection mechanisms 304 eject fluid, it is the printheads 306 and 308 of the fluid-ejection mechanisms 304 that actually eject fluid, and more specifically the fluid is ejected through the nozzles of the printheads 306 and 308. The fluid-ejection mechanisms 304 eject fluid onto media 310 as the media 310 moves past the rollers 302, such as from left to right or from right to left in FIG. 3.

In the embodiment where the fluid-ejection device 100 is an inkjet-printing device, the device in question may be an inkjet printer, or another type of device that has inkjet-printing functionality. In such embodiments, the fluid-ejection mechanisms 304 are inkjet mechanisms, or inkjet pens. Likewise, in such embodiments, the printheads 306 and 308 are inkjet printheads.

The fluid-ejection mechanisms 304 are positioned relative to the rollers 302 in FIG. 3 as follows. A first roller center line 312A is defined in relation to the roller 302A, and a second roller center line 312B is defined in relation to the roller 302B, where the roller center lines 312A and 312B are collectively referred to as the roller center lines 312. As noted above, a roller center line defines the center line of a roller, such that at least substantially half of the roller in question is to one side of the center line and at least substantially half of this roller is to the other side of the center line.

Furthermore, the fluid-ejection mechanism 304A includes a positioning line 314A and the fluid-ejection mechanism 304B includes a positioning line 314B, where the positioning lines 314A and 314B are collectively referred to as the positioning lines 314. As noted above, a positioning line is defined as the line through the fluid-ejection mechanism in question such that the printheads of the fluid-ejection mechanism are at least substantially equally positioned to either side of the positioning line. For example, the positioning line 314A is defined at least substantially equally between the printheads 306, and the positioning line 314B is defined at least substantially equally between the printheads 308.

Between the roller center lines 312 of the rollers 302, the media 310 is substantially flat and is substantially parallel to the fluid-ejection mechanisms 304. However, to the left of the roller center line 312A of the roller 302A and to the right of the roller center line 312B of the roller 302B, the media 310 is not necessarily substantially flat, and is not substantially parallel to the fluid-ejection mechanisms 304. Rather, to the left of the roller center line 312 and to the right of the roller center line 312B, the media 310 falls away from the fluid-ejection mechanisms 304, in often an imprecise and curved manner.

In the embodiment of FIG. 3, the fluid-ejection mechanisms 304 are positioned relative to the rollers 302 such the positioning lines 314 are slightly inwards of the roller center lines 312. That is, the positioning line 314A is positioned slightly to the right of the roller center line 312A, and the positioning line 314B is positioned slightly to the left of the roller center line 312B. In one embodiment, the rollers 302 each have a diameter of 61 millimeters, the distance between the roller center lines 312 is 95 millimeters, and the distance between the positioning lines 314 is 89.9 millimeters. Thus, in this embodiment, the positioning line 314A is positioned 2.55 millimeters to the right of the roller center line 312A, and the positioning line 314B is positioned 2.55 millimeters to the left of the roller center line 312B.

In the embodiment of FIG. 3, then, the fluid-ejection mechanisms 304 are positioned relative to the rollers 302 such that the printheads 306A and 308A are only partially, and not completely, located between the roller center lines 312; that is, some part of each of the printheads 306A and 308A lies outside the roller center lines 312. The fluid-ejection mechanisms 304 are further positioned relative to the rollers 302 such that the printheads 306B and 308B are completely located between the roller center lines 312; that is, no part of each of the printheads 306B and 308B lies outside of the roller center lines 312. It is noted, therefore, that the solution contemplated by FIG. 3 differs from the solution described in the previous section of the detailed description, in which all the printheads of both the fluid-ejection mechanisms are completely located between the roller center lines.

Figure 4:
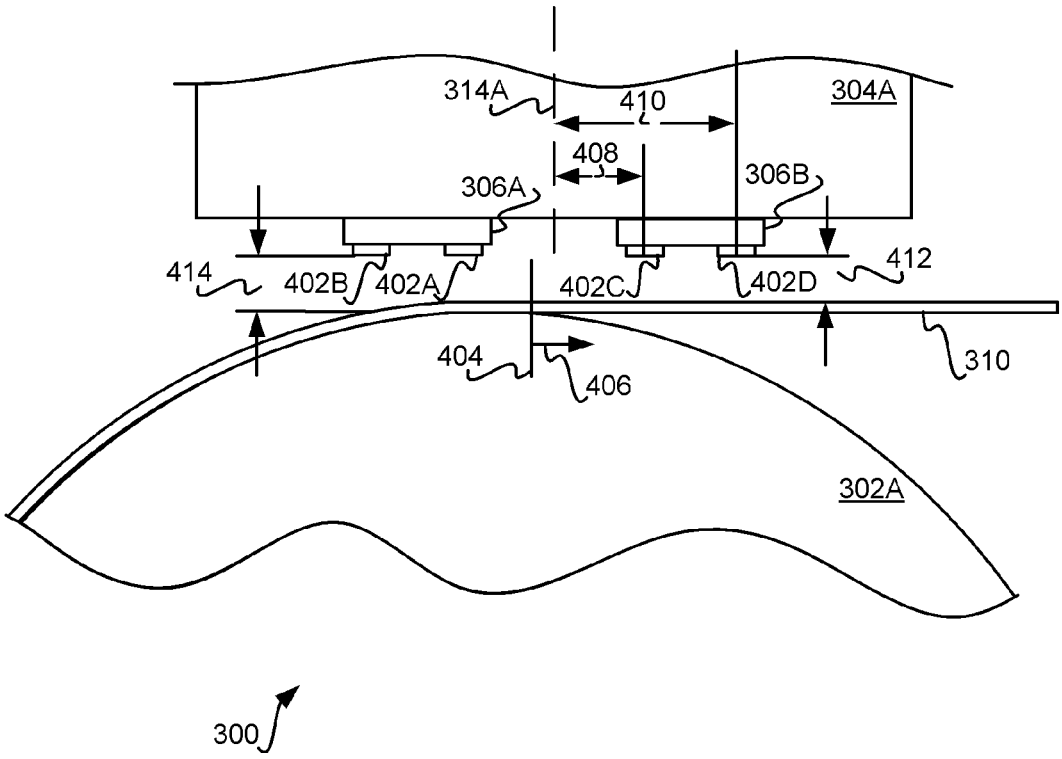
FIG. 4 is a diagram of a portion of the fluid-ejection device of FIG. 3 in detail, according to an embodiment of the present disclosure.

FIG. 4 shows a portion of the fluid-ejection device 300 in more detail according to an embodiment of the present disclosure. In particular, FIG. 4 depicts a portion of the roller 302A and a portion of the fluid-ejection mechanism 304A, including the printheads 306, in detail. It is noted that the roller 302B and the fluid-ejection mechanism 304B are a mirror image of the roller 302A and the fluid-ejection mechanism 304A. As such, the description of FIG. 4 in relation to the roller 302A and the fluid-ejection mechanism 304A is representative of both the rollers 302 and both the fluid-ejection mechanism 304. The difference is just that the positioning line 314A of the fluid-ejection mechanism 304A is located slightly to the right of the roller center line 312A of the roller 302A, whereas the positioning line 314B of the fluid-ejection mechanism 304B is located slightly to the left of the roller center line 312B of the roller 302B. It is noted that FIG. 4 is not necessarily drawn to scale, for illustrative clarity and convenience.

In FIG. 4, the printhead 306A of the fluid-ejection mechanism 304A is depicted as including an inner row of fluid-ejection nozzles 402A and an outer row of fluid-ejection nozzles 402B. Likewise, the printhead 306B includes an inner row of fluid-ejection nozzles 402C and an outer row of fluid-ejection nozzles 402C. The rows of fluid-ejection nozzles 402A, 402B, 402C, and 402D are collectively referred to as the rows of fluid-ejection nozzles 402. The fluid-ejection nozzles 402 are organized in rows perpendicular to the plane of FIG. 4. Thus, in FIG. 4, just four actual fluid-ejection nozzles 402A, 402B, 402C, and 402D can be seen.

Dimensionally, in one embodiment, the fluid-ejection nozzles 402C are centered 2.77 millimeters to the right of the positioning line 314A, as indicated by the reference number 408, and the fluid-ejection nozzles 402D are centered 5.23 millimeters to the right of the positioning line 314A, as indicated by the reference number 410. Similarly, in this embodiment, the fluid-ejection nozzles 402A are centered 2.77 millimeters to the left of the positioning line 314A. Likewise, the fluid-ejection nozzles 402B are centered 5.23 millimeters to the left of the positioning line 314A.

In FIG. 4, the spacings between the fluid-ejection nozzles 402C and 402D of the printhead 306B and the media 310 and the spacing between the fluid-ejection nozzles 402A of the printhead 306A and the media 310 are all at least substantially equal to one another. That is, the spacing between the fluid-ejection nozzles 402C and the media 310 is at least substantially equal to the spacing between the fluid-ejection nozzles 402D and the media 310, which is at least substantially equal to the spacing between the fluid-ejection nozzles 402A and the media 310. In one embodiment, this spacing may be 1.0 millimeter, as indicated by the reference number 412. It is noted that the media 310 is substantially flat and parallel to the bottom of the fluid-ejection mechanism 304A from a location substantially under the nozzles 402A and continuing to the right.

By comparison, the spacing between the fluid-ejection nozzles 402B of the printhead 306A and the media 310 is slightly unequal to the spacings between the fluid-ejection nozzles 402A, 402C, and 402D and the media 310. In one embodiment, this spacing may be about 1.1 millimeters, as indicated by the reference number 414. It is noted that the difference of about 10% in the spacing between the fluid-ejection nozzles 402B and the media 310 and the spacing between the fluid-ejection nozzles 402A, 402C, and 402D and the media 310 has been judged to be an acceptable printhead-media spacing variation. That is, the inventors have determined that this minimal variation in printhead-media spacing impacts printing quality only slightly. Thus, by moving the fluid-ejection mechanism 304A slightly inwards of the roller 302A, the printhead-media spacing in relation to the fluid-ejection nozzles 402B is improved to the point where the remaining spacing variation is acceptable and just slightly impacts printing quality.

The media 310 is not supported by the roller 302A starting from the point 404 and continuing to the right, as indicated by the arrow 406. As such, the media 310 is unsupported at the locations where the fluid-ejection nozzles 402C and 402D of the printhead 306B eject fluid onto the media 310. However, the amount by which the media 310 is unsupported where the fluid-ejection nozzles 402C and 402D eject fluid onto the media 310 is significantly less than in the solution noted in the previous section of the detailed description, in which the fluid-ejection mechanisms are moved significantly inwards of the rollers. That is, while moving the fluid-ejection mechanism 304A slightly inwards of the roller 302A renders the media 310 slightly more susceptible to flutter (due to vibrations within the fluid-ejection device 300 causing the media 310 to move quickly up and down), this increase in flutter susceptibility has been judged by the inventors to be an acceptable tradeoff to realize a particular advantage. This advantage, namely, is the substantially equal printhead-media spacing in relation to the fluid-ejection nozzles 402A, 402C, and 402D, and just a slight variation in the printhead-media spacing in relation to the fluid-ejection nozzles 402B.

Therefore, as to the row of fluid-ejection nozzles 402A, the portion of the media 310 incident to the nozzles 402A is at least substantially supported by the roller 302A while fluid is ejected through the nozzles 402A onto this portion of the media 310. By comparison, as to the row of fluid-ejection nozzles 402B, the portion of the media 310 incident to the nozzles 402B is unsupported by the roller 302A and is at least partially non-parallel to the fluid-ejection mechanism 304A while fluid is ejected through the nozzles 402B onto this portion of the media 310. As to the rows of fluid-ejection nozzles 402C and 402D, the portions of the media 310 incident to the nozzles 402C and 402D are unsupported by the roller 302B but are at least substantially flat and parallel to the fluid-ejection mechanism 304A while fluid is ejected through the nozzles 402C and 402D onto these portions of the media 310.

The novel approach invented by the inventors as embodied in FIGS. 3 and 4 of the present disclosure represents a relatively sophisticated and nuanced solution to the problems described in the previous section of the detailed description. These problems are not necessarily completely solved, but rather are minimized in an acceptable manner considering all the potential tradeoffs. For example, moving the positioning line 314A slightly inwards of the roller center line 312A decreases the printhead-media spacing variation in relation to the fluid-ejection nozzles 402B to an acceptable amount, while minimally increasing the extent to which the media 310 is unsupported at the locations where the fluid-ejection nozzles 402C and 402D eject fluid. In other words, the inventors have determined that that slight increase in the risk of flutter resulting from the media 310 being less supported where the fluid-ejection nozzles 402C and 402D eject fluid is a worthy tradeoff due to the decrease in printhead-media spacing variation in relation to the fluid-ejection nozzles 402B.

In this way, therefore, the approach invented by the inventors as embodied in FIGS. 3 and 4 is a relatively sophisticated and nuanced solution, in that both the media instability problem and the printhead-media spacing problem are considered. The original approach of FIG. 1, in which the fluid-ejection mechanisms 104 have positioning lines 114 collinear with the roller center lines 112 of the rollers 102, as described in the previous section of the detailed description, prioritizes media stability over printhead-media spacing. That is, in that approach, the media stability is considered a paramount concern to printhead-media spacing. By comparison, the approach in which the fluid-ejection mechanisms are moved well inwards of the rollers 102, as described in the previous section of the detailed description, prioritizes printhead-media spacing over media stability. That is, in that approach, the spacing between the printhead and the media is considered a paramount concern to media stability.

What the inventors have thus concluded is that both printhead-media spacing and media stability are concerns that should be addressed. This insight is novel, because heretofore it was likely thought either that only printhead-media spacing can be the concern driving the positioning of fluid-ejection mechanisms in relation to rollers, or that only media stability can be concern driving the positioning of fluid-ejection mechanisms in relation to rollers. This is because both problems cannot be completely solved at the same time. As a result prior approaches have focused on only one problem or the other, but not both problems.

By comparison, the inventors invented an approach that provides an acceptable tradeoff between the printhead-media spacing problem and the media stability problem. In short, the inventors unintuitively decided to increase media instability in the embodiment of FIGS. 3 and 4 as compared to the approach of FIG. 1, but just slightly. The advantage to this slight increase in media instability is that, by comparison, the printhead-media spacing problem is substantially, albeit not completely, solved. That is, the spacing between the printhead 306A and the media 310 at the fluid-ejection nozzles 402B is still greater (or more generally, different) than the spacing between the printheads 306 and the media 310 at the fluid-ejection nozzles 402A, 402B, and 402C, but just slightly.

After significant effort and innovation, therefore, the inventors have determined that it is worth slightly increasing the instability of the media 310 incident to the fluid-ejection nozzles 402C and 402D to achieve lesser printhead-media spacing variation, specifically as to the spacing between the printhead 306A and the media 310 at the fluid-ejection nozzles 402B. The slight increase in the susceptibility of media flutter affecting the print quality resulting from fluid ejected on the media 310 by the fluid-ejection nozzles 402C and 402D is an acceptable risk in light of decreasing the printhead-media spacing variation so that, in one embodiment, the spacing represented by the reference number 414 is only about 10% off from the spacing represented by the reference number 412. The inventors thus have novelly and inventively addressed both printhead-media spacing variation and media instability in arriving at the solution embodied in FIGS. 3 and 4.

Particular Embodiments

Figure 5:
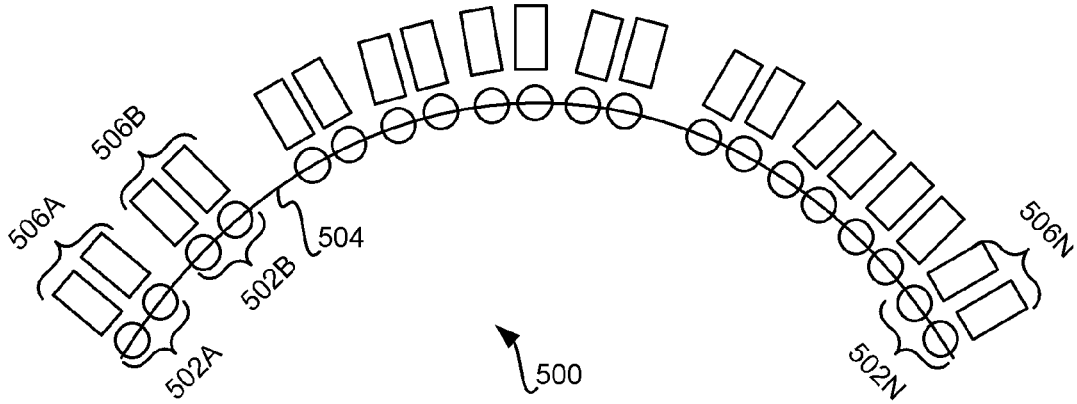
FIG. 5 is a diagram of a roller-based fluid-ejection device, according to another embodiment of the present disclosure.

In this section of the detailed description, various particular embodiments of the present disclosure are described, in relation to which the solution presented in the previous section of the detailed description can be employed. FIG. 5 shows a fluid-ejection device 500, according to an embodiment of the disclosure. The fluid-ejection device 500 includes roller pairs 502A, 502B, . . . , 502N, collectively referred to as the roller pairs 502, as well as corresponding fluid-ejection mechanism pairs 506A, 506B, . . . , 506N, collectively referred to as the fluid-ejection mechanism pairs 506. In the embodiment of FIG. 5, there are specifically ten rollers pairs 502 and ten corresponding fluid-ejection mechanism pairs 506. The roller pairs 502 and the fluid-ejection mechanism pairs 506 are positioned along an arc 504.

Each of the roller pairs 502 and each of the corresponding fluid-ejection mechanism pairs 506A can be implemented as has been described above in relation to FIGS. 3 and 4. Thus, for example, one roller of the roller pair 502A may be implemented as the roller 302A of FIGS. 3 and 4, and the other roller of the roller pair 502A may be implemented as the roller 302B of FIG. 3. Likewise, one fluid-ejection mechanism of the fluid-ejection mechanism pair 506A may be implemented as the fluid-ejection mechanism 304A of FIGS. 3 and 4, and the other fluid-ejection mechanism of the fluid-ejection mechanism pair 506B may be implemented as the fluid-ejection mechanism pair 304B of FIG. 4.

Figure 6:
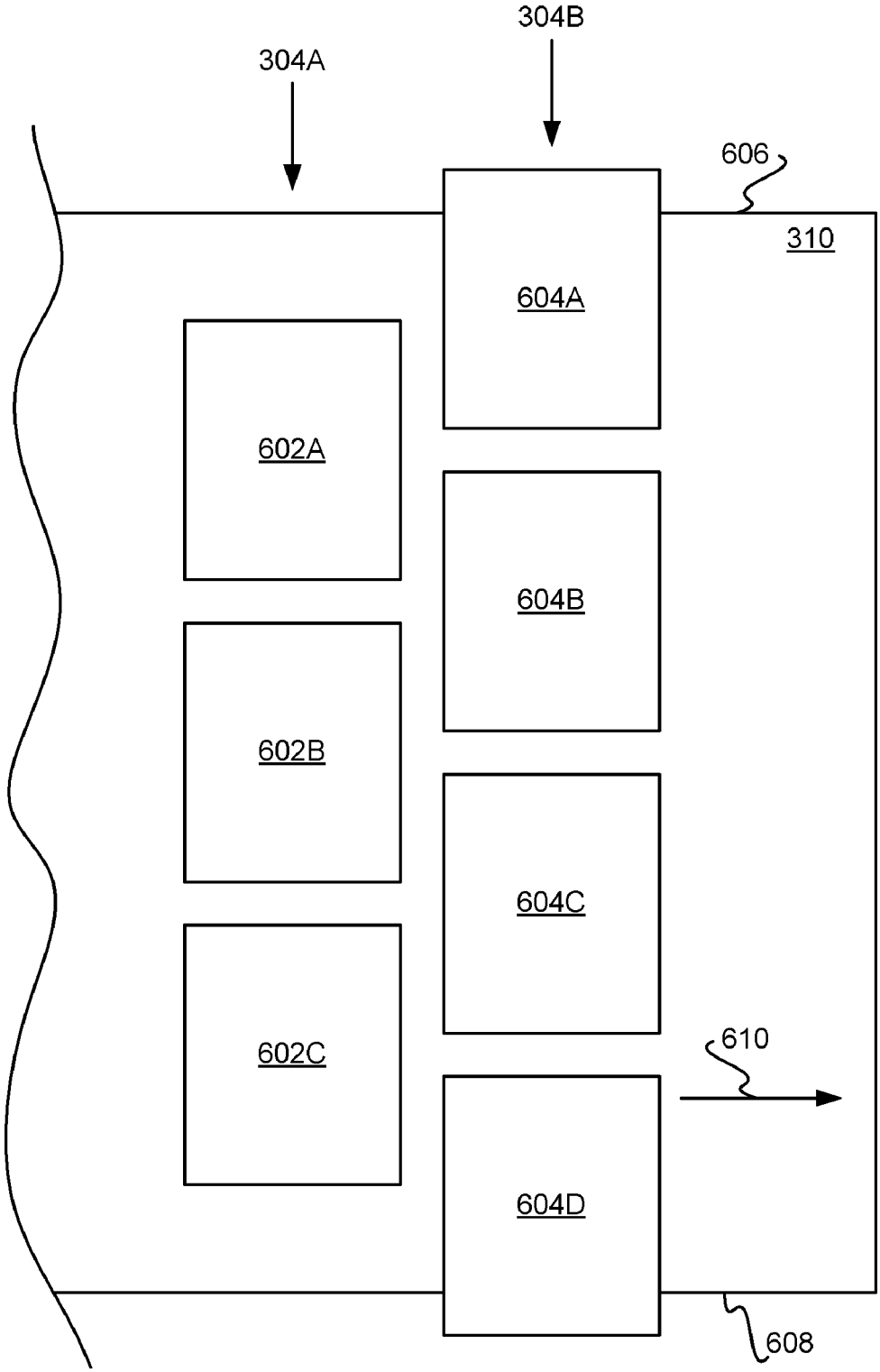
FIG. 6 is a diagram depicting how a single fluid-ejection mechanism can be implemented in actuality as a number of fluid-ejection mechanisms, according to an embodiment of the present disclosure.

FIG. 6 shows how each of the fluid-ejection mechanisms 304 of FIG. 3 can in actuality be implemented as a number of fluid-ejection mechanisms according to an embodiment of the present disclosure. Whereas FIG. 3 depicts a side view of the fluid-ejection mechanisms 304, FIG. 6 depicts a top view of the fluid-ejection mechanisms 304. Thus, whereas the side edge of the media 310 is depicted in FIG. 3, the top surface of the media 310 is depicted in FIG. 6.

In the embodiment of FIG. 6, the fluid-ejection mechanism 304A is actually made up of a row of three fluid-ejection mechanisms 602A, 602B, and 602C, collectively referred to as the fluid-ejection mechanisms 602. Similarly, the fluid-ejection mechanism 304B is actually made up of a row four fluid-ejection mechanisms 604A, 604B, 604C, and 604D, collectively referred to as the fluid-ejection mechanisms 604. In other embodiments, the number of the fluid-ejection mechanisms 602 and 604 can vary.

The fluid-ejection mechanisms 602 are positioned in a staggered manner in relation to the fluid-ejection mechanisms 604, and vice-versa, as can be seen in FIG. 6. Thus, in the particular embodiment of FIG. 6, the fluid-ejection mechanisms 602 and 604 are organized in what is referred to as a page-wide array extending from one edge 606 of the media 310 to the other edge 608 of the media 310, and perpendicular to the direction of movement of the media 310 indicated by the arrow 610. In this respect, the fluid-ejection mechanisms 602 and 604 implementing the fluid-ejection mechanisms 304 may be stationary while they eject fluid onto the media 310 moving past them, while still permitting fluid to be ejected over the entire width of the media 310 from the edge 606 to the edge 608.

Figure 7:
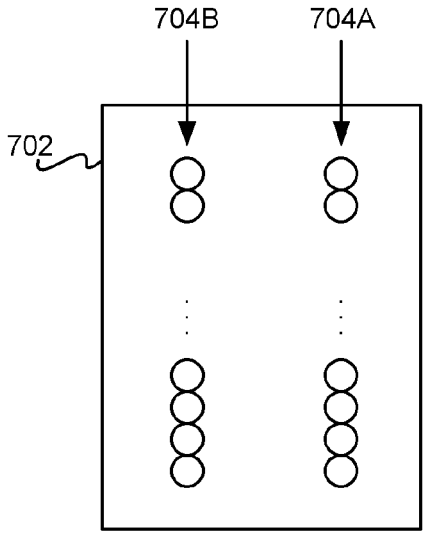
FIG. 7 is a diagram depicting how a representative printhead can be implemented, according to an embodiment of the present disclosure.

FIG. 7 shows an implementation of a representative printhead 702, according to an embodiment of the present disclosure. The printhead 702 can implement each of the printheads 306 and 308 of the fluid-ejection mechanisms 304 of FIG. 3, for instance. Whereas FIG. 3 depicts a side view of the printheads 306 and 308, FIG. 7 depicts a bottom view of the printhead 702, such as by looking up from the bottom of the sheet of FIG. 3 towards the bottom of the printheads 306 and 308. The printhead 702 has two rows of fluid-ejection nozzles 704A and 704B, collectively referred to as the rows of fluid-ejection nozzles 704. In other embodiments, there may be fewer than or greater than two rows of fluid-ejection nozzles 704 as is specifically depicted in FIG. 7.

Figure 8:
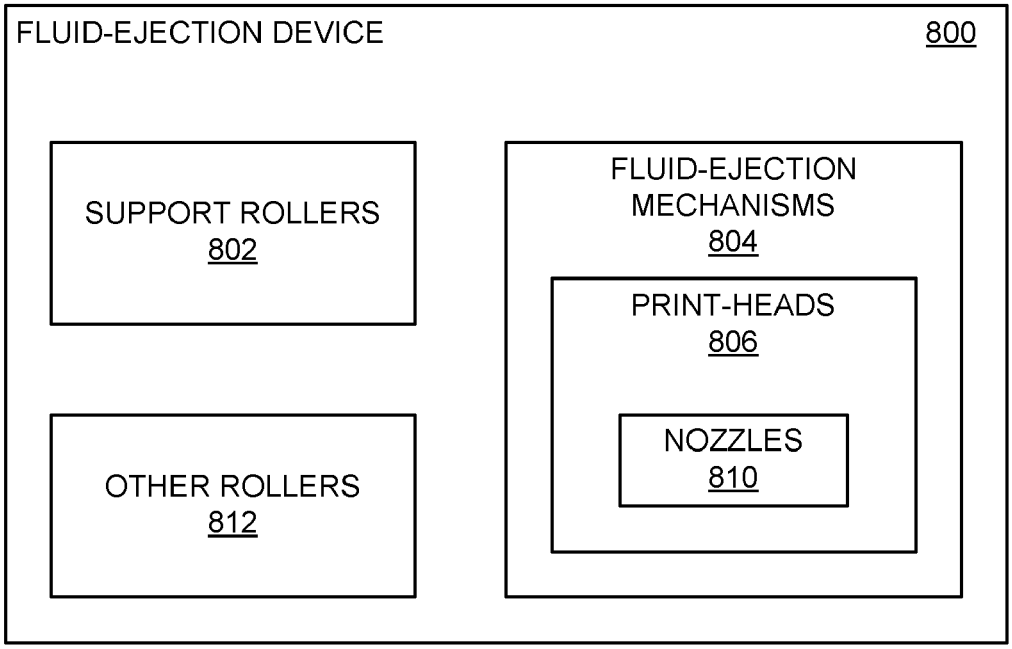
FIG. 8 is a block diagram of a rudimentary roller-based fluid-ejection device, according to another embodiment of the present disclosure.

Finally, FIG. 8 shows a block diagram of a rudimentary fluid-ejection device 800, according to an embodiment of the present disclosure. The fluid-ejection device 800 can be implemented as the fluid-ejection device 300 of FIG. 3 that has been described, for instance. As such, the fluid-ejection device 800 includes a number of support rollers 802 and a corresponding number of fluid-ejection mechanisms 804. As can be appreciated by those of ordinary skill within the art, the fluid-ejection device 800 can and typically does include other components, in addition to and/or in lieu of the support rollers 802 and the fluid-ejection mechanisms 804. For instance, FIG. 8 shows the fluid-ejection device 800 as including one or more other rollers 812, in addition to the support rollers 802.

The rollers 802 are referred to as support rollers to distinguish them from the other rollers 812. The rollers 802 are typified by the rollers 302 of FIG. 3 that have been described above. That is, the rollers 302 that have been described can be considered support rollers. The fluid-ejection mechanisms 804 are typified by the fluid-ejection mechanisms 304 of FIG. 3 that have been described above. As such, the fluid-ejection mechanisms 804 include printheads 806, which may be typified by the printheads 306 and 308 of FIG. 3, as well as fluid-ejection nozzles 810, which may be typified by the fluid-ejection nozzles 402 of FIG. 4.

The other rollers 812 may include media supply rollers, media guide rollers, and/or media take-up rollers, as can be appreciated by those of ordinary skill within the art, as well as other types of rollers other than the support rollers 802 that have been exemplarily described in relation to the rollers 302 of FIG. 3. It is noted, for instance, the support rollers 802 define a print zone in which fluid is ejected onto a portion of media while the portion of media is located within the print zone. For example, in relation to FIG. 3, the print zone is defined by the rollers 302, since the portion of the media located at the rollers 302 is the portion on which the fluid-ejection mechanisms 304 eject fluid.

By comparison, referring back to FIG. 8, a media supply roller may provide a roll of blank media, such as a continuous roll of paper, that is guided by one or more media guide rollers to the support rollers 802 for ejection of fluid by the fluid-ejection mechanisms 804 onto the media when the media is located at the support rollers 802. Thereafter, one or more additional guide rollers may guide the media, as has had fluid ejected thereon, onto a take-up roller. The take-up roller may be powered by a motor to rotate the take-up roller, whereas the other rollers, including the support rollers 802, may not be powered.

Thus, it can be said that the fluid-ejection mechanisms 804 are located closer to the support rollers 802 than they are to any other roller 812 of the fluid-ejection device 800. For example, in relation to FIG. 3 in which the fluid-ejection mechanisms 304 typify the fluid-ejection mechanisms 804 and the rollers 302 typify the support rollers 802, the fluid-ejection mechanisms 304 are very close to the rollers 802, by the thickness of the media 310 plus about 1.0-to-1.1 millimeters. As such, to the extent that there are any other rollers within the fluid-ejection device 300 of FIG. 3, the fluid-ejection mechanisms 304 are closer to the rollers 302 than to these other rollers.

CONCLUDING METHODS

Figure 9:
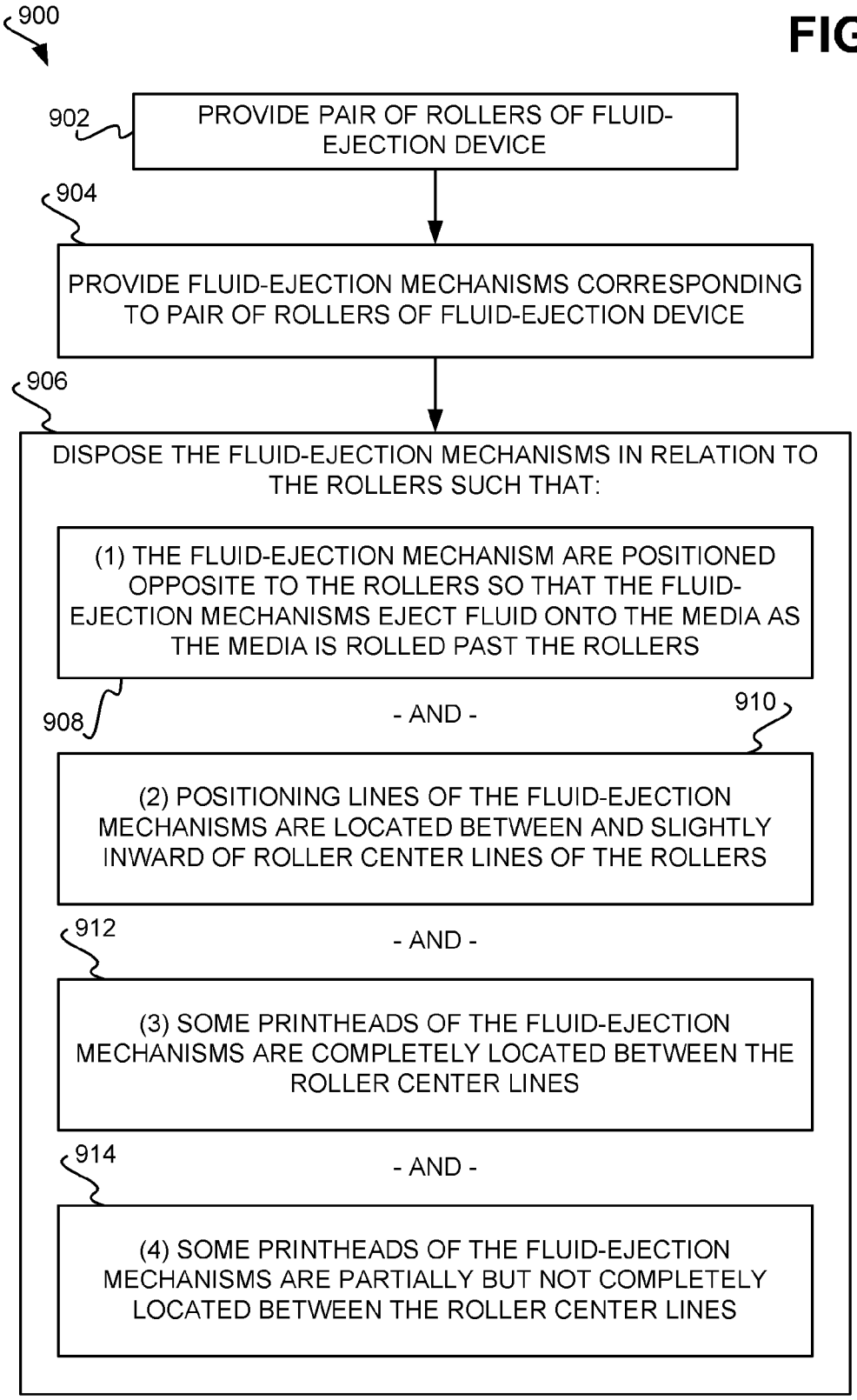
FIG. 9 is a method for making a roller-based fluid-ejection device, according to an embodiment of the present disclosure.
Figure 10:
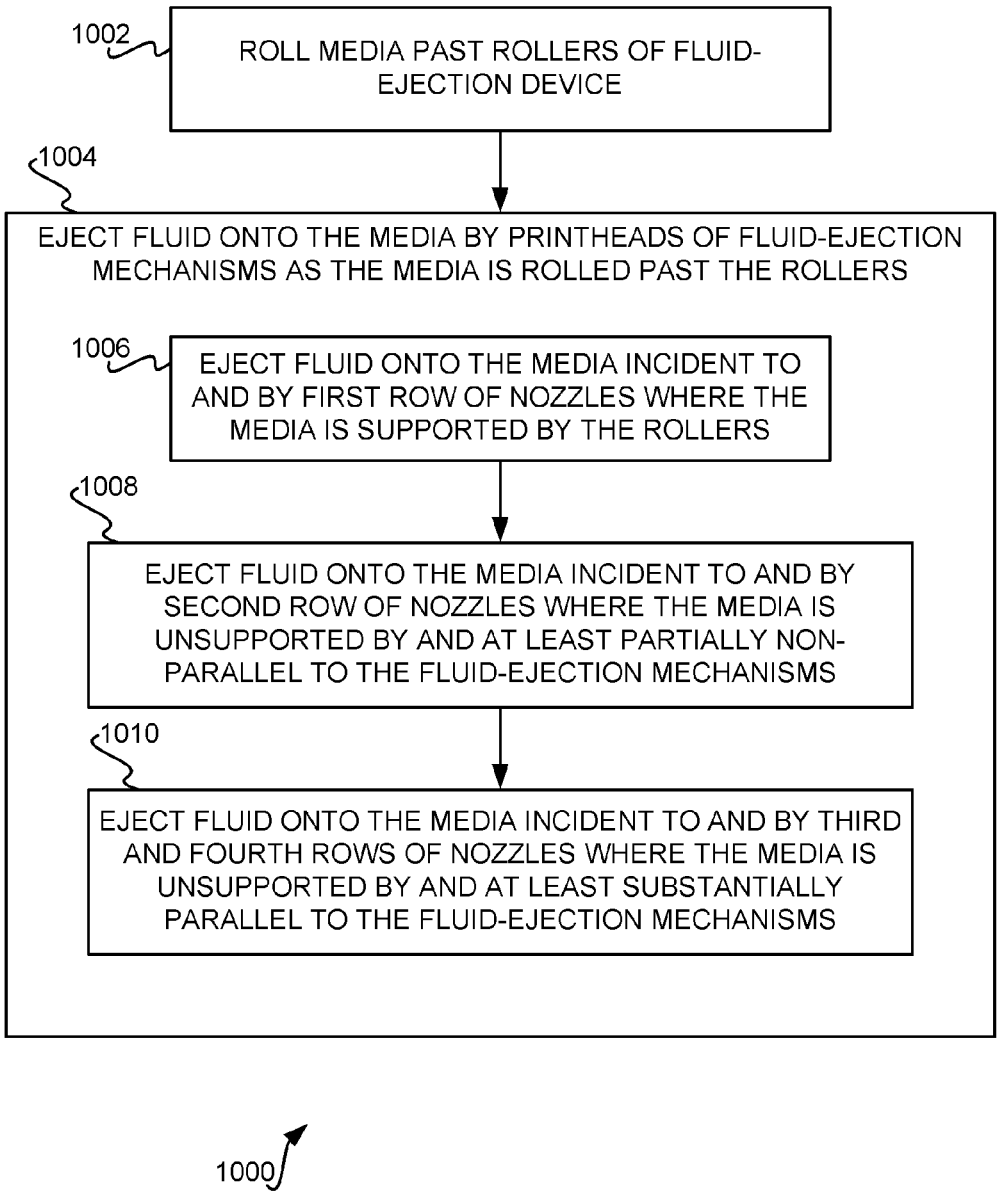
FIG. 10 is a method for using a roller-based fluid-ejection device, according to an embodiment of the present disclosure.

In conclusion, FIGS. 9 and 10 show a method 900 for making a fluid-ejection device and a method 1000 for using a fluid-ejection device, respectively, according to varying embodiments of the present disclosure. The methods 900 and 1000 are described in relation to the fluid-ejection device 300 of FIGS. 3 and 4 that have been described above. In FIG. 9, the pair of rollers 302 is provided (902). The roller 302A has a roller center line 312A, whereas the roller 302B has a roller center line 312B.

The fluid-ejection mechanisms 304 corresponding to the rollers 302 are also provided (904). The fluid-ejection mechanism 304A has the printheads 306, whereas the fluid-ejection mechanism 304B has the printheads 308. The positioning line 314A is defined at least substantially equally between the printheads 306, whereas the positioning line 314B is defined at least substantially equally between the printheads 308.

The fluid-ejection mechanisms 304 are disposed in relation to the rollers 302 to satisfy the following four conditions (906). First, the fluid-ejection mechanisms 304 are positioned opposite the rollers 302 so that the mechanisms 304 eject fluid onto the media 310 as the media is rolled past the rollers 302 (908). Second, the positioning lines 314 are located between and slightly inward of the roller center lines 312 (910). Third, the printheads 306B and 308B are completely located between the roller center lines 312 (912). Fourth, the printheads 306A and 308A are partially but not completely located between the roller center lines 312 (914).

In FIG. 10, the media 310 is rolled past the rollers 302 (1002). Fluid is ejected onto the media 310 by the printheads 306 and 308 of the fluid-ejection mechanisms 304 as the media 310 is rolled past the rollers 302 (1004). For instance, in specific relation to the printheads 306, the row of nozzles 402A ejects fluid onto the media 310 where the media 310 is incident to the nozzles 402A, and where the media 310 is supported by the roller 302A (1006). The row of nozzles 402B ejects fluid onto the media 310 where the media 310 is incident to the nozzles 402B, and where the media 310 is unsupported by and at least partially non-parallel to (the bottoms of) the fluid-ejection mechanism 304 (1008). Finally, the rows of nozzles 402C and 402D eject fluid onto the media 310 where the media 310 is incident to the nozzles 402C and 402D, and where the media 310 is unsupported by and at least substantially parallel to (the bottoms of) the fluid-ejection mechanisms 304 (1010).

We claim:

1. A fluid-ejection device comprising:

a pair of rollers including a first roller and a second roller, the first roller having a first roller center line, the second roller having a second roller center line; and, a plurality of fluid-ejection mechanisms disposed opposite to the pair of rollers such that the fluid-ejection mechanisms are to eject fluid onto the media as the media is rolled past the first and the second rollers, the fluid-ejection mechanisms including one or more first fluid-ejection mechanisms and one or more second fluid-ejection mechanisms, wherein the first fluid-ejection mechanisms comprise one or more first printheads and one or more second printheads to eject the fluid onto the media, a first positioning line of the first fluid-ejection mechanisms defined at least substantially equally between the first and the second printheads, wherein the second fluid-ejection mechanisms comprise one or more third printheads and one or more fourth printheads to eject the fluid onto the media, a second positioning line of the second fluid-ejection mechanisms defined at least substantially equally between the third and the fourth printheads, and wherein the first and the second fluid-ejection mechanisms are positioned in relation to the rollers such that the first and the second positioning lines are located between the first and the second roller center lines, such that the first and the third printheads are not completely located between the first and the second roller center lines, and such that the second and the fourth printheads are completely located between the first and the second roller center lines.

2. The fluid-ejection device of claim 1, wherein the rollers define a print zone in which fluid is ejected onto a portion of media while the portion of the media is located within the print zone.

3. The fluid-ejection device of claim 1, wherein the first and the second fluid-ejection mechanisms are located closer to the first and the second rollers than to any other roller of the fluid-ejection device.

4. The fluid-ejection device of claim 1, wherein the first printheads comprise a first row of fluid-ejection nozzles and a second row of fluid-ejection nozzles through which the fluid is ejected, the first row located closer to the first positioning line than the second row is, wherein the second printheads comprise a third row of fluid-ejection nozzles and a fourth row of fluid-ejection nozzles through which the fluid is ejected, the third row located closer to the first positioning line than the fourth row is, and wherein the first row is located closer to the first roller center line than the second row, the third row, and the fourth row are.

5. The fluid-ejection device of claim 4, wherein a portion of the media incident to the first row of fluid-ejection nozzles is supported by the first roller while the fluid is ejected through the first row of fluid-ejection nozzles onto the portion of the media.

6. The fluid-ejection device of claim 4, wherein a portion of the media incident to the second row of fluid-ejection nozzles is at least partially non-parallel to the first fluid-ejection mechanisms while the fluid is ejected through the second row of fluid-ejection nozzles onto the portion of the media.

7. The fluid-ejection device of claim 4, wherein a portion of the media incident to the third and the fourth rows of fluid-ejection nozzles is unsupported by the first roller and is at least substantially parallel to the first fluid-ejection mechanisms while the fluid is ejected through the third and the fourth rows of fluid-ejection nozzles onto the portion of the media.

8. The fluid-ejection device of claim 4, wherein the third printheads comprise a fifth row of fluid-ejection nozzles and a sixth row of fluid-ejection nozzles through which the fluid is ejected, the fifth row located closer to the second positioning line than the sixth row is, wherein the fourth printheads comprise a seventh row of fluid-ejection nozzles and an eighth row of fluid-ejection nozzles through which the fluid is ejected, the seventh row located closer to the second positioning line than the eighth row is, and wherein the fifth row is located closer to the second roller center line than the sixth row, the seventh row, and the eighth row are.

9. The fluid-ejection device of claim 8, wherein a first portion of the media incident to the fifth row of fluid-ejection nozzles is supported by the second roller while the fluid is ejected through the fifth row of fluid-ejection nozzles onto the first portion of the media, wherein a second portion of the media incident to the sixth row of fluid-ejection nozzles is at least partially non-parallel to the second fluid-ejection mechanisms while the fluid is ejected through the sixth row of fluid-ejection nozzles onto the second portion of the media, and wherein a third portion of the media incident to the seventh and the eighth rows of fluid-ejection nozzles is unsupported by the second roller and is at least substantially parallel to the second fluid-ejection mechanisms while the fluid is ejected through the seventh and the eighth rows of fluid-ejection nozzles onto the third portion of the media.

10. The fluid-ejection device of claim 1, wherein the one or more first fluid-ejection mechanisms comprise a plurality of first fluid-ejection mechanisms organized in a first row and the one or more second fluid-ejection mechanisms comprise a plurality of second fluid-ejection mechanisms organized in a second row, wherein the second fluid-ejection mechanisms are positioned in a staggered manner in relation to the first fluid-ejection mechanisms, and wherein the first and the second fluid-ejection mechanisms are organized in a page-wide array at least substantially perpendicular to a direction of movement of the media within the fluid-ejection device.

11. The fluid-ejection device of claim 1, wherein the pair of rollers is a first pair of rollers, the plurality of fluid-ejection mechanisms is a first plurality of fluid-ejection mechanisms, and the fluid-ejection device further comprises:

a second pair of rollers including a third roller and a fourth roller, the third roller having a third roller center line, the fourth roller having a fourth roller center line; and, a second plurality of fluid-ejection mechanisms disposed opposite to the second pair of rollers such that the second plurality of fluid-ejection mechanisms are to eject fluid onto the media as the media is rolled past the third and the fourth rollers, the second plurality of fluid-ejection mechanisms including one or more third fluid-ejection mechanisms and one or more fourth fluid-ejection mechanisms, wherein the third fluid-ejection mechanisms comprise one or more fifth printheads and one or more sixth printheads to eject the fluid onto the media, a third positioning line of the third fluid-ejection mechanisms defined at least substantially equally between the fifth and the sixth printheads, wherein the fourth fluid-ejection mechanisms comprise one or more seventh printheads and one or more eighth printheads to eject the fluid onto the media, a fourth positioning line of the fourth fluid-ejection mechanisms defined at least substantially equally between the seventh and the eighth printheads, and wherein the second plurality of fluid-ejection mechanisms are positioned in relation to the second pair of rollers such that the third positioning line is located between the third and the fourth roller center lines and closer to the third roller center line, and such that the fourth positioning line is located between the third and the fourth roller center lines and closer to the fourth roller center line.

12. The fluid-ejection device of claim 11, further comprising:

one or more additional pairs of rollers other than the first pair of rollers and the second pair of rollers; and, one or more additional pluralities of fluid-ejection mechanisms other than the first plurality of fluid-ejection mechanisms and the second plurality of fluid-ejection mechanisms, the additional pluralities of fluid-ejection mechanisms corresponding to the additional pairs of rollers.

13. The fluid-ejection device of claim 1, wherein the first, the second, the third, and the fourth printheads are inkjet printheads, wherein the first and the second fluid-ejection mechanisms are inkjet mechanisms, and wherein the fluid-ejection device is an inkjet-printing device.

14. A method of making a fluid-ejection device, comprising:

providing a pair of rollers of the fluid-ejection device, the rollers including a first roller and a second roller, the first roller having a first roller center line, the second roller having a second roller center line;

providing a plurality of fluid-ejection mechanisms of the fluid-ejection device, the fluid-ejection mechanisms including one or more first fluid-ejection mechanisms and one or more second fluid-ejection mechanisms, where the first fluid-ejection mechanisms comprise one or more first printheads and one or more second printheads to eject the fluid onto the media, a first positioning line of the first fluid-ejection mechanisms defined at least substantially equally between the first and the second printheads, and where the second fluid-ejection mechanisms comprise one or more third printheads and one or more fourth printheads to eject the fluid onto the media, a second positioning line of the second fluid-ejection mechanisms defined at least substantially equally between the third and the fourth printheads; and, disposing the fluid-ejection mechanisms in relation to the rollers such that:

the first and the second fluid-ejection mechanisms are positioned opposite to the pair of rollers such that the fluid-ejection mechanisms are to eject fluid onto the media as the media is rolled past the first and the second rollers, the first and the second positioning lines are located between the first and the second roller center lines, the first and the third printheads are not completely located between the first and the second roller center lines, and the second and the fourth printheads are completely located between the first and the second roller center lines.

15. A method of using a fluid-ejection device, comprising:

rolling media past a pair of rollers of the fluid-ejection device including a first roller and a second roller, the first roller having a first roller center line, the second roller having a second roller center line; and, ejecting fluid onto the media by one or more first printheads and one or more second printheads of one or more first fluid-ejection mechanisms of the fluid-ejection device and by one or more third printheads and one or more fourth printheads of one or more second fluid-ejection mechanisms of the fluid-ejection device, as the media is rolled past the first and the second rollers, wherein a first positioning line of the first fluid-ejection mechanisms is defined at least substantially equally between the first and the second printheads, and a second positioning line of the second fluid-ejection mechanisms is defined at least substantially equally between the third and the fourth printheads, wherein the first and the second positioning lines are located between the first and the second roller center lines, the first and the third printheads are not completely located between the first and the second roller center lines, and the second and the fourth printheads are completely located between the first and the second roller center lines, and where ejecting the fluid onto the media comprises:

ejecting the fluid onto a first portion of the media incident to and by a first row of fluid-ejection nozzles of the first printheads while the first portion of the media is supported by the first roller;

ejecting the fluid onto a second portion of the media incident to and by a second row of fluid-ejection nozzles of the first printheads while the second portion of the media is at least partially non-parallel to the first fluid-ejection mechanisms; and, ejecting the fluid onto a third portion of the media incident to and by a third row and a fourth row of fluid-ejection nozzles of the second printheads while the third portion of the media is unsupported by the first roller and is at least substantially parallel to the first fluid-ejection mechanisms.

* * * * *